US007090037B2

(12) United States Patent
Best

(10) Patent No.: US 7,090,037 B2
(45) Date of Patent: Aug. 15, 2006

(54) DEVICE FOR ANCHORING A DRILL STRING IN A BOREHOLE

(75) Inventor: Bruno Best, Rijswijk (NL)

(73) Assignee: Shell Oil Company, Houston, TX (US)

( * ) Notice: Subject to any disclaimer, the term of this patent is extended or adjusted under 35 U.S.C. 154(b) by 231 days.

(21) Appl. No.: 10/250,725

(22) PCT Filed: Jan. 8, 2002

(86) PCT No.: PCT/EP02/00115

§ 371 (c)(1),
(2), (4) Date: Jul. 8, 2003

(87) PCT Pub. No.: WO02/055834

PCT Pub. Date: Jul. 18, 2002

(65) Prior Publication Data

US 2004/0055788 A1 Mar. 25, 2004

(30) Foreign Application Priority Data

Jan. 10, 2001 (EP) ..... 01300180

(51) Int. Cl.
*E21B 23/01* (2006.01)
*E21B 4/18* (2006.01)

(52) U.S. Cl. ..... 175/230; 175/99; 166/212

(58) Field of Classification Search ..... 175/57, 175/61, 78, 92, 97, 98, 99, 230, 320, 321, 175/325.1; 166/212
See application file for complete search history.

(56) References Cited

U.S. PATENT DOCUMENTS 2,743,781 A * 5/1956 Lane ..... 166/212
2,777,522 A * 1/1957 Page ..... 166/212
3,105,561 A 10/1963 Kellner ..... 175/230
3,131,769 A 5/1964 Rochemont ..... 166/212
3,138,214 A * 6/1964 Bridwell ..... 175/230
3,180,437 A * 4/1965 Kellner et al. ..... 175/230
3,225,843 A * 12/1965 Ortloff et al. ..... 175/93
3,430,698 A * 3/1969 Urbanosky ..... 166/212
3,497,019 A * 2/1970 Ortloff ..... 175/27
3,512,592 A * 5/1970 Kellner ..... 175/5
RE28,449 E * 6/1975 Edmond ..... 175/94
4,102,415 A * 7/1978 Cunningham ..... 175/96
4,615,401 A * 10/1986 Garrett ..... 175/230
5,186,264 A * 2/1993 du Chaffaut ..... 175/27
5,531,280 A 7/1996 Steinkamp et al.
6,003,606 A 12/1999 Moore et al. ..... 166/381
6,241,031 B1 * 6/2001 Beaufort et al. ..... 175/99

(Continued)

FOREIGN PATENT DOCUMENTS

EP 0497422 A1 * 8/1992

(Continued)

OTHER PUBLICATIONS

International Search Report dated May 8, 2002.

*Primary Examiner*—Jennifer H. Gay

(57) ABSTRACT

A device for anchoring a drill string in a borehole an anchoring member connected to the drill string, the anchoring member being movable between a retracted position in which the anchoring member is retracted from the borehole wall, and, an extended position in which the anchoring member is extended against the borehole wall so as to anchor the drill string to the borehole wall, and an activating member operable to move the anchoring member from the extended position to the retracted position by the action of pressure of drilling fluid present in the borehole.

9 Claims, 3 Drawing Sheets

U.S. PATENT DOCUMENTS

| | | | | |
|---|---|---|---|---|
| 6,679,341 | B1 * | 1/2004 | Bloom et al. | 175/51 |
| 2002/0088648 | A1 * | 7/2002 | Krueger et al. | 175/99 |
| 2004/0045719 | A1 * | 3/2004 | Moore et al. | 166/383 |
| 2004/0168828 | A1 * | 9/2004 | Mock et al. | 175/51 |

FOREIGN PATENT DOCUMENTS

| | | |
|---|---|---|
| WO | 99/09290 | 2/1999 |

* cited by examiner

DEVICE FOR ANCHORING A DRILL STRING IN A BOREHOLE

The present application claims priority on European Patent Application 01300180.5, filed on Jan. 10, 2001.

FIELD OF THE INVENTION

The present invention relates to a device for anchoring a drill string in a borehole formed in an earth formation. In drilling deep boreholes or drilling boreholes at high inclination angles, it is a common problem to provide sufficient forward thrust to the drill bit. Frictional forces between the drill string an the borehole wall largely reduce the effective weight of the drill string providing forward thrust to the drill bit.

BACKGROUND OF THE INVENTION

International patent application WO 99/09290 discloses a drill string system provided with a thruster to thrust the drill bit in forward direction, and an anchoring device including radially extendible grippers with actuator pistons to anchor the drill string to the borehole wall during activation of the thruster.

A problem of the known anchoring device is that a separate actuating means is required to bring the pistons (and thereby also the grippers) back to their retracted position after drilling of a further borehole section.

SUMMARY OF THE INVENTION

It is an object of the invention to provide an improved anchoring device which overcomes the drawbacks of the prior art anchoring device.

In accordance with the invention there is provided a device for anchoring a drill string in a borehole formed in an earth formation, comprising:

an anchoring member connected to the drill string and being movable between a retracted position in which the anchoring member is retracted from the borehole wall and an extended position in which the anchoring member is extended against the borehole wall so as to anchor the drill string to the borehole wall; and an activating member operable to move the anchoring member from the extended position to the retracted position by the action of pressure of drilling fluid present in the borehole.

It is thereby achieved that the anchoring member is brought back to its retracted position by the pressure of drilling fluid in the borehole acting on the activating member, thereby obviating the need for a separate actuating means.

Suitably the activating member is arranged to move the anchoring member from the extended position to the retracted position by the action of said pressure of drilling fluid being present in an annular space between the drill string and the borehole wall.

It is preferred that the activating member includes a piston/cylinder assembly arranged to move the anchoring member from the extended position to the retracted position upon a relative axial movement between the piston and the cylinder by the action of said pressure of drilling fluid acting on the piston.

BRIEF DESCRIPTION OF THE DRAWINGS

The invention will be described hereinafter in more detail and by way of example, with reference to the accompanying drawings in which the examples should not be construed to limit the scope of the invention.

In the Figures, like reference numerals relate to like components.

DETAILED DESCRIPTION OF THE PREFERRED EMBODIMENT

Figure 1:
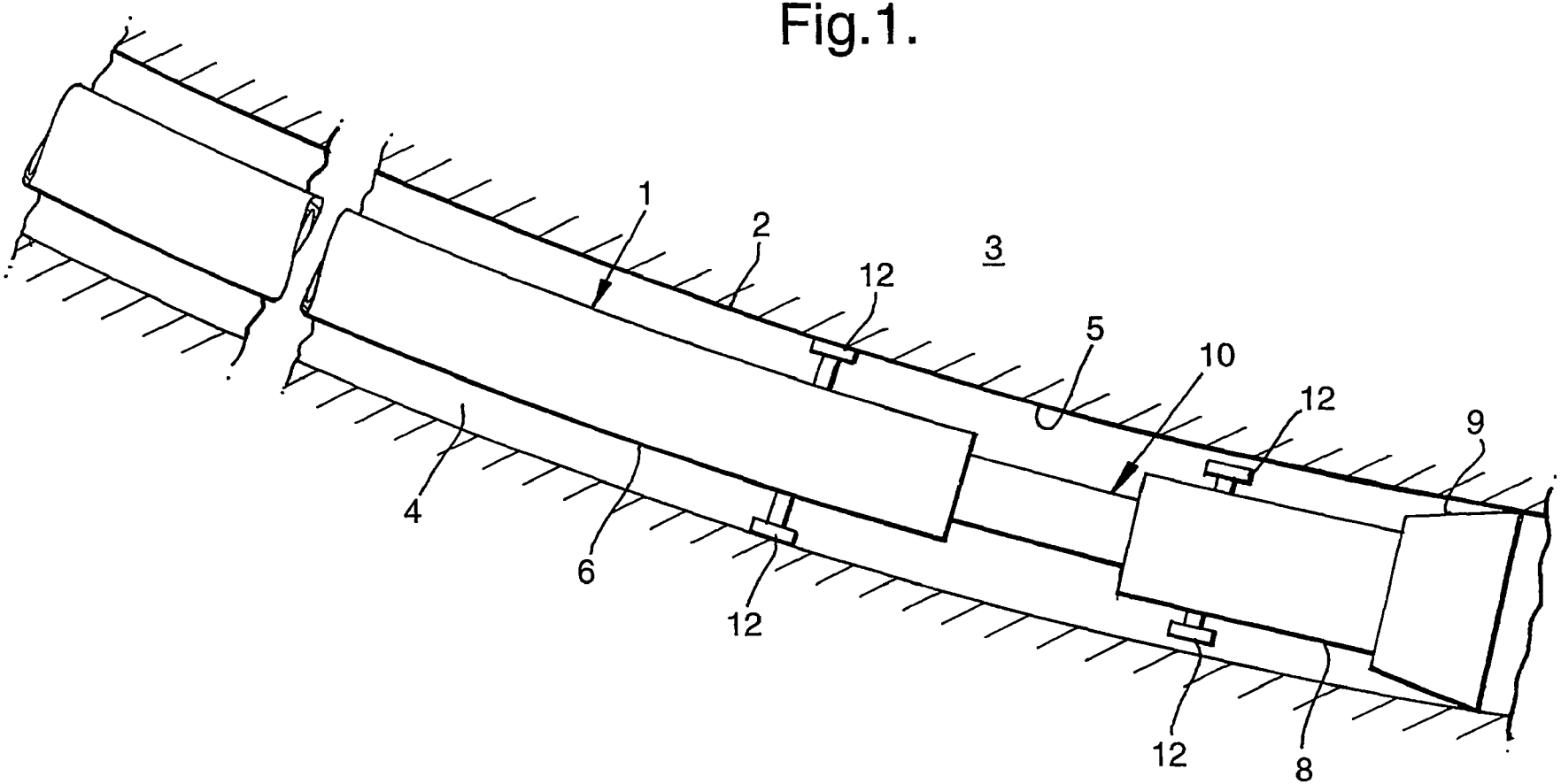
FIG. 1 schematically shows a drilling assembly in which the device of the invention is applied.

Referring to FIG. 1 there is shown a drill string 1 extending into a borehole 2 formed in an earth formation 3, with an annular space 4 between the drill string and the borehole wall 5. The drill string has an upper part 6 and a lower part 8 provided with a drill bit 9, whereby the parts 6, 8 are interconnected by a hydraulically activated telescoping thruster 10 capable of thrusting the lower drill string part 8 in the direction of the borehole bottom. The upper drill string part 6 and the lower drill string part 8 are provided with respective sets of anchoring members 12 (e.g. three) in the form of pads regularly spaced along the drill string circumference. Each pad 12 is connected to the respective drill string part 6, 8 in a manner that the pad 12 is movable between a retracted position in which the pad 12 is retracted from the borehole wall 5 and an extended position in which the pad 12 is extended against the borehole wall 5 so as to anchor the respective drill string part 6, 8 to the borehole wall 5. The drill string is internally provided with a control system (schematically shown in FIG. 2) for controlling movement of each pad 12 between its retracted position and its extended position.

Figure 2:
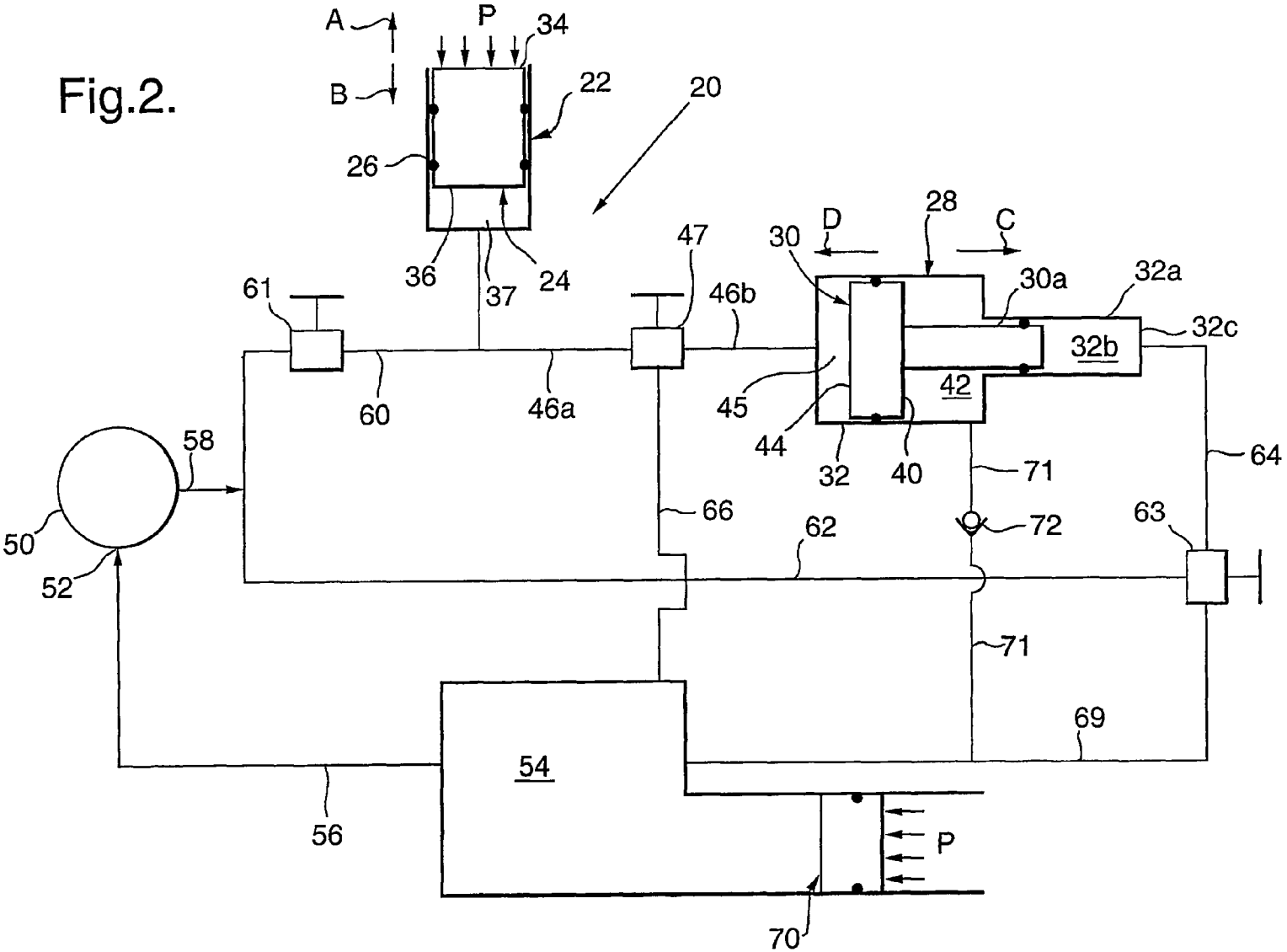
FIG. 2 schematically shows an embodiment of a hydraulic control system for use in the device of the invention.

Referring further to FIG. 2 there is shown a schematic representation of the control system for controlling movement of the pads 12, which comprises a hydraulic circuit 20 including a first piston/cylinder assembly 22 with a piston 24 which sealingly extends into a cylinder 26 and which is axially movable relative to the cylinder 26 in outward direction A and inward direction B. The control system further comprises a second piston/cylinder assembly 28 with a piston 30 which sealingly extends into a cylinder 32 and which is axially movable relative to the cylinder 32 in opposite directions C and D. The piston 30 is provided with an auxiliary piston 30*a* which sealingly extends into an auxiliary cylinder 32*a* connected to the cylinder 32. A fluid chamber 32*b* is defined in the auxiliary cylinder 32*a* between the auxiliary piston 30*a* and an end wall 32*c* of the auxiliary cylinder 32*a*. The auxiliary piston 30*a* is of smaller outer diameter than the piston 30, and the auxiliary cylinder 30*a* is of smaller inner diameter than the cylinder 32.

The piston 24 has an outer end surface 34 which is subjected to a pressure P of drilling fluid present in the annular space 4, and an inner end surface 36 subjected to a pressure of hydraulic fluid present in a fluid chamber 37 of the cylinder 26. The piston 24 is connected by connecting means (not shown) to the pads 12 in a manner that the piston 24 induces the pads 12 to move to their extended position upon movement of the piston 24 in outward direction A, and that the piston 24 induces the pads 12 to move to their retracted position upon movement of the piston 24 in inward direction B.

The piston 30 has a first end surface 40 in fluid communication with a low pressure chamber 42 of the second assembly 28 and a second end surface 44 subjected to a pressure of hydraulic fluid present in a fluid chamber 45 of the cylinder 32. The low pressure chamber 42 contains a gas at low pressure or, ideally, is vacuum. The chamber 37 is in fluid communication with the fluid chamber 45 via conduits 46*a*, 46*b* and a three-way valve 47.

The hydraulic circuit 20 furthermore comprises a hydraulic fluid pump 50 having an inlet 52 in fluid communication with a hydraulic fluid reservoir 54 via a conduit 56, and an outlet 58 in fluid communication with the chamber 37 via a conduit 60 provided with a valve 61. The outlet 58 is furthermore in fluid communication with the first fluid chamber 32*b* via a conduit 62, a three-way valve 63 and a conduit 64. The fluid reservoir 54 is in fluid communication with the conduit 46 via a conduit 66 and the three-way valve 47, and with the conduit 64 via a conduit 69 and the three-way valve 63. Fluid reservoir 54 is pressure compensated by means of a piston 70 provided to the reservoir 54, which piston 70 transfers the drilling fluid pressure P to the hydraulic fluid present in fluid reservoir 54. Furthermore low pressure chamber 42 is connected via a conduit 71 to conduit 69, which conduit 71 is provided with a one-way valve 72 allowing fluid to flow only from chamber 42 to conduit 69.

The piston 24 is connected by connecting means (not shown) to the pads 12 in a manner that the piston 24 induces the pads 12 to move to their extended position upon movement of the piston 24 in outward direction A, and that the piston 24 induces the pads 12 to move to their retracted position upon movement of the piston 24 in inward direction B.

Figure 3:
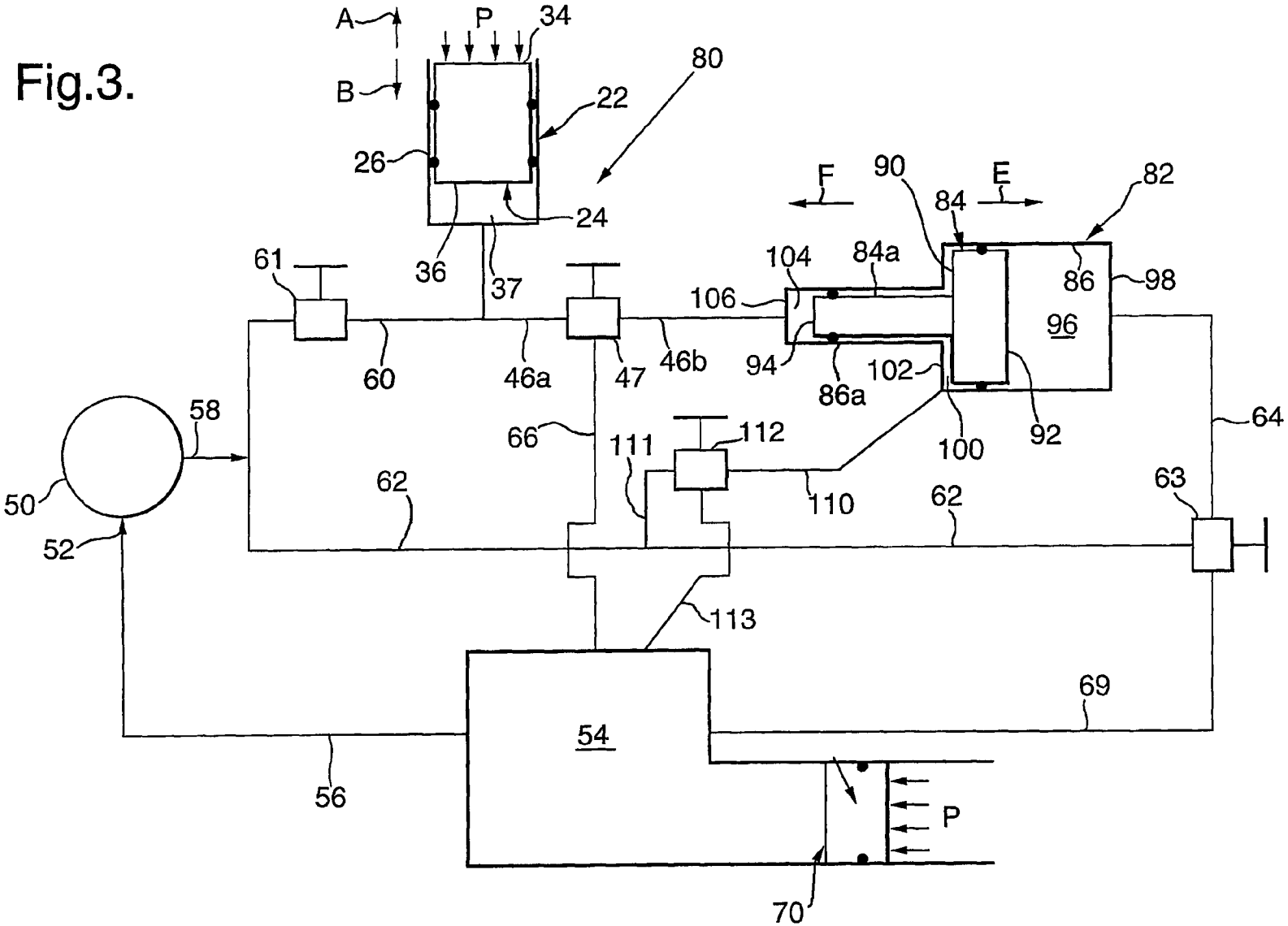
FIG. 3 schematically shows an alternative embodiment of a hydraulic control system for use in the device of the invention.

Referring to FIG. 3 there is shown a schematic representation of the alternative control system for controlling movement of the pads 12. The alternative control system comprises a hydraulic circuit 80 which is similar to the control circuit 20, except that in the hydraulic circuit 80 a third piston/cylinder assembly 82 replaces the second piston/cylinder assembly 28 referred to hereinbefore. The third piston/cylinder assembly 82 includes a piston 84 which sealingly extends into a cylinder 86 and which is axially movable relative to the cylinder 86 in opposite directions E and F. The piston 84 is provided with an auxiliary piston 84*a* which extends into an auxiliary cylinder 86*a* connected to the cylinder 86. The piston 84 has an end surface 90 at the side of the auxiliary piston 84*a* and an end surface 92 opposite the end surface 90. The auxiliary piston 84*a* has an end surface 94. A first fluid chamber 96 is defined in the cylinder 86, between the end surface 92 and an end wall 98 of the cylinder 86. A second fluid chamber 100 is defined in the cylinder 86, between the end surface 90 and the other end wall 102 of the cylinder 86. A third fluid chamber 104 is defined in the auxiliary cylinder 86*a*, between the end surface 94 and an end wall 106 of the auxiliary cylinder 86*a*. The first fluid chamber 96 is in fluid communication with the outlet 58 of the pump 50 via the three-way valve 63. The second fluid chamber 100 is in fluid communication with the conduit 62 via conduits 110, 111 and a three-way valve 112, and with the hydraulic fluid reservoir 54 via conduits 110, 113 and the three-way valve 112.

In the following description normal use of the device according to the invention is described for activation and de-activation of a single pad 12 of upper drill string part 6, with the understanding that activation and de-activation of the other pads 12 occurs in a similar manner.

During normal use of the device with the control system of FIG. 2, the valve 61 is opened and the three-way valve 47 is opened such that fluid can flow via conduits 46*a*, 46*b* into fluid chamber 45. Three-way valve 63 is opened such that fluid can flow from chamber 32*b* via conduits 64, 69 into reservoir 54. Next the pump 50 is operated to pump hydraulic fluid from the fluid reservoir 54 into the fluid chamber 37 of cylinder 26 and into chamber 45 of cylinder 32. As a result piston 24 moves in outward direction A and thereby moves the pads 12 against the borehole wall 5 so as to anchor the upper drill string part 6 in the borehole, and piston 30 and auxiliary piston 30*a* move in direction C thereby discharging any hydraulic fluid which might have leaked into low pressure chamber 42, to fluid reservoir 54 via conduits 71, 69 and one-way valve 72. Then three-way valve 47 is opened such that fluid can flow via conduits 46*b* and 66 into reservoir 54, and three-way valve 63 is opened such that hydraulic fluid flows from outlet 58 of pump 50 via conduits 62, 64 into fluid chamber 32*b* of cylinder 32*a* thereby pushing piston 30 and auxiliary piston 30*a* in direction D. As a result a very low gas pressure (or preferably vacuum) is created in chamber 42. The borehole 2 is then further drilled by simultaneously rotating the drill bit 9 and inducing the thruster 10 to thrust the drill bit 9 against the borehole bottom. After drilling of a further borehole section is completed, rotation of the drill bit 9 and operation of the pump 50 is stopped, whereafter the valve 61 is closed. The valve 47 is then opened so as to bring conduit 46*a* in fluid communication with conduit 46*b*, and the valve 63 is opened so as to bring chamber 32*b* in communication with reservoir 54 via conduits 64, 69. As a result the drilling fluid pressure P moves the piston 24 in inward direction B whereby hydraulic fluid flows from fluid chamber 37 via conduits 46*a*, 46*b* into fluid chamber 45, and from chamber 32*b* into reservoir 54, and the piston 30 and auxiliary piston 30*a* move in the direction C by virtue of the pressure in fluid chamber 45 being larger than the pressure (or vacuum) in low pressure chamber 42. The pads 12 are retracted from the borehole wall 5 by the inward movement of the piston 24.

In a next step the upper drill string part 6 is moved further downward in the borehole. Then the valve 63 is opened so as to bring conduit 62 in fluid communication with conduit 64, and the valve 47 is opened so as to bring conduit 46*b* in fluid communication with conduit 66. The pump 50 is then operated to pump hydraulic fluid from reservoir 54 via conduits 62, 64 into the fluid chamber 32*b* thereby pushing auxiliary piston 30*a* and piston 30 in direction D. Hydraulic fluid present in fluid chamber 45 flows thereby via conduits 46*b* and 66 into reservoir 54. Thereafter the pads 12 are again extended against the borehole wall 5 in the manner described hereinbefore, and a yet further borehole section is drilled.

Normal use of the device with the control system of FIG. 3 is substantially similar to normal use of the device with the control system of FIG. 2. Valve 61 is opened, and the three-way valve 47 is opened such that fluid can flow via conduits 46*b* and 66 into reservoir 54. Three-way valve 112 is opened such that fluid from chamber 100 can be discharged via conduits 110 and 113 into reservoir 54. Three-way valve 63 is opened such that chamber 96 is hydraulically connected via conduits 64 and 62 to the pump-outlet 58. Then the pump 50 is operated to pump hydraulic fluid from the fluid reservoir 54 into the fluid chamber 37 of cylinder 26 and into chamber 96 of cylinder 82. As a result the piston 24 moves in outward direction A and thereby moves the pads 12 against the borehole wall 5 so as to anchor the upper drill string part 6 to the borehole wall 5, and piston 84 and auxiliary piston 84*a* move in direction F thereby discharging hydraulic fluid from fluid chambers 100 and 104 into reservoir 54. The borehole 2 is then further drilled by simultaneously rotating the drill bit 9 and inducing the thruster 10 to thrust the drill bit 9 against the borehole bottom. After drilling of a further borehole section is completed, rotation of the drill bit 9 is stopped. Valve 61 is closed, and valve 47 is then opened so as to bring chamber 37 in fluid communication with chamber 104 via conduit 46*a* and conduit 46*b*. Three-way valve 63 is opened such that fluid can be discharged from chamber 96 via conduits 64 and 69 into reservoir 54. Three-way valve 112 is opened such that chamber 100 is in fluid communication with pump-outlet 58 via conduits 110, 111 and 62. By pumping hydraulic fluid into chamber 100, piston 84 and auxiliary piston 84*a* are pushed in direction E. As a result the drilling fluid pressure P moves the piston 24 in inward direction B whereby hydraulic fluid flows from fluid chamber 37 via conduits 46*a*, 46*b* into fluid chamber 104, and from chamber 96 into reservoir 54. The pads 12 are retracted from the borehole wall 5 by the inward movement of the piston 24.

Instead of opening the valve 61 and closing the valve 47 before operating the pump 50 to move the piston 24 in outward direction A, the following alternative procedure can suitably be followed. The valve 61 is closed, the valve 63 is opened so as to provide fluid communication between conduits 62, 64, and the valve 47 is opened so as to provide fluid communication between conduits 46*a*, 46*b*. The valve 112 is opened so as to provide fluid communication between chamber 100 and reservoir 54 via conduits 110, 113. The pump 50 is then operated so as to pump hydraulic fluid via conduits 62, 64 into the first fluid chamber 96, with the result that the piston 84 and auxiliary piston 84*a* move in direction F. Hydraulic fluid is thereby displaced from the third fluid chamber 104 via conduits 46*b*, 46*a* into the fluid chamber 37 of cylinder 26, resulting in movement of the piston 26 in outward direction A. The alternative procedure has the advantage that the fluid pressure in fluid chamber 37 is substantially increased during pumping due to the piston 84 being of larger diameter than auxiliary piston 84*a*.

During a suitable drilling procedure, the pads 12 of the lower drill string part 8 are extended against the borehole wall only during periods of time that the pads 12 of the upper drill string member are retracted from the borehole wall in order to provide a reactive torque to the lower drill string part in case of continued rotation of the drill bit which is driven by a downhole motor.

Instead of, or in addition to, moving the piston 30, 84 of the second or third piston/cylinder assembly 28, 82 in respective directions C or E by the action of a fluid pressure difference across the piston 30, 84, such movement can be achieved by the action of a spring arranged in a suitable manner in the second or third piston/cylinder assembly.

In the above description the anchoring member and the corresponding activating member are described as separate components. Alternatively, the anchoring member and the corresponding activating member can be integrally formed as a single component.

The Invention claimed is:

1. A device for anchoring a drill string in a borehole formed in an earth formation, comprising:

an anchoring member connected to the drill string and being movable between a retracted position in which the anchoring member is retracted from the borehole wall and an extended position in which the anchoring member is extended against the borehole wall so as to anchor the drill string to the borehole wall;

an activating member operable to move the anchoring member from the extended position to the retracted position by the action of pressure of drilling fluid present in the borehole, wherein the activating member includes a first piston/cylinder assembly arranged to move the anchoring member from the extended position to the retracted position upon a relative axial movement between the first piston and the first cylinder by the action of said pressure of drilling fluid acting on the first piston;

a pressure reduction means comprising a further piston/cylinder assembly in fluid communication with the first piston/cylinder assembly via a hydraulic fluid conduit, said further piston/cylinder assembly being arranged to reduce the hydraulic fluid pressure exerted to the piston of the first piston/cylinder assembly by a relative axial movement between the piston and cylinder of the further assembly, thereby inducing the action of the drilling fluid present in the borehole to move the anchoring member from the extended position to the retracted position.

2. The device of claim 1, wherein the activating member is arranged to move the anchoring member from the extended position to the retracted position by the action of said pressure of drilling fluid being present in an annular space between the drill string and the borehole wall.

3. The device of claim 1, further comprising a control system for selectively inducing a force to the first piston which counter-acts said relative axial movement between the first piston and the first cylinder thereby counter-acting movement of the anchoring member from the extended position to the retracted position.

4. The device of claim 3, wherein the control system includes a hydraulic circuit arranged to induce said force to the piston by exertion of a hydraulic fluid pressure to the piston.

5. The device of claim 4, wherein the hydraulic circuit is provided with powering means for inducing a pressure difference across the piston of the further piston/cylinder assembly so as to induce said relative axial movement between the piston and cylinder of the further assembly.

6. The device of claim 5, wherein the powering means includes a low pressure chamber in fluid communication with an end surface of the piston of the further assembly.

7. The device of claim 5 or 6, wherein the powering means includes a high pressure chamber in fluid communication with the piston of the further assembly and a pump for pumping hydraulic fluid into the high pressure chamber.

8. The device of claim 7, wherein the pump comprises the hydraulic fluid pump and is arranged to selectively pump hydraulic fluid to the first piston/cylinder assembly so as to induce the piston of the first piston/cylinder assembly to move the anchoring member from the retracted to the extended position.

9. The device of claim 1, wherein a valve is provided in the hydraulic conduit.

* * * * *